US009040470B2

(12) United States Patent
Yagishita

(10) Patent No.: US 9,040,470 B2
(45) Date of Patent: May 26, 2015

(54) LUBRICATING OIL COMPOSITION FOR SLIDING SECTION COMPRISING ALUMINUM MATERIAL, AND LUBRICATING METHOD

(75) Inventor: Kazuhiro Yagishita, Chiyoda-ku (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 0 days.

(21) Appl. No.: 13/885,904

(22) PCT Filed: Jul. 26, 2011

(86) PCT No.: PCT/JP2011/066946

§ 371 (c)(1),
(2), (4) Date: May 16, 2013

(87) PCT Pub. No.: WO2012/066823

PCT Pub. Date: May 24, 2012

(65) Prior Publication Data

US 2013/0237463 A1 Sep. 12, 2013

(30) Foreign Application Priority Data

Nov. 19, 2010 (JP) ..... 2010-259584

(51) Int. Cl.

| | |
|---|---|
| ***C10M 163/00*** | (2006.01) |
| ***C10M 141/10*** | (2006.01) |
| ***C10M 137/10*** | (2006.01) |
| ***C07F 9/00*** | (2006.01) |
| ***C10M 137/04*** | (2006.01) |

(52) U.S. Cl.

CPC ..... *C10M 137/10* (2013.01); *C10M 141/10* (2013.01); *C10M 2219/068* (2013.01); *C10M 2223/04* (2013.01); *C10M 2223/042* (2013.01); *C10M 2223/045* (2013.01); *C10M 2227/09* (2013.01); *C10N 2210/06* (2013.01); *C10N 2230/06* (2013.01); *C10N 2240/02* (2013.01); *C10N 2240/04* (2013.01); *C10N 2240/042* (2013.01); *C10N 2240/044* (2013.01); *C10N 2240/08* (2013.01); *C10N 2240/12* (2013.01); *C10N 2240/30* (2013.01); *C10N 2250/10* (2013.01); *C10M 137/04* (2013.01); *C10M 2205/0285* (2013.01); *C10N 2240/00* (2013.01)

(58) Field of Classification Search

CPC ..... C10M 2219/068; C10M 2223/045; C10M 2201/02

USPC ..... 508/365, 461, 430, 364, 377

See application file for complete search history.

(56) References Cited

U.S. PATENT DOCUMENTS

| | | | | |
|---|---|---|---|---|
| 5,922,657 | A | 7/1999 | Camenzind et al. | |
| 2004/0053794 | A1 | 3/2004 | Baba | |
| 2005/0107269 | A1 * | 5/2005 | Yagishita et al. ..... | 508/440 |

FOREIGN PATENT DOCUMENTS

| | | | |
|---|---|---|---|
| CN | 1671827 | A | 9/2005 |
| EP | 1516910 | A1 | 3/2005 |
| JP | 5-070785 | A | 3/1993 |
| JP | 10-067993 | A | 3/1998 |
| JP | 2002-265971 | A | 9/2002 |
| JP | 2004-149762 | A | 5/2004 |
| JP | 2004-331895 | A | 11/2004 |
| JP | 2005-239897 | A | 9/2005 |
| JP | 2007-106855 | A | 4/2007 |

OTHER PUBLICATIONS

Seiya Igari, et al., "Effects of Molecular structure of aliphatic diols and polyalkylene glycol as lubricants on the wear of aluminum", Wear, 2000, pp. 180-184, vol. 244.

International Searching Authority, International Preliminary Report on Patentability issued in corresponding International Application No. PCT/JP2011/066946, dated Jun. 12, 2013.

* cited by examiner

*Primary Examiner* — Vishal Vasisth

(74) *Attorney, Agent, or Firm* — Sughrue Mion, PLLC

(57) ABSTRACT

Provided are a lubricant composition capable of reducing friction between sliding parts at least one of which contains an aluminum-based material in a lubrication section, and a method for lubricating an aluminum-based member with the composition. The lubricant composition is for use in a lubrication section having sliding parts at least one of which contains an aluminum-based material, and contains a lubricant base oil and at least one of a phosphorus-containing carboxylic compound and a metal salt thereof (component (A)) at 0.001 to 1 mass % of the composition in terms of phosphorus. The composition may suitably be used as lubricant such as drive train lubricant for automatic or manual transmissions, grease, wet brake oil, hydraulic actuation oil, turbine oil, compressor oil, bearing oil, refrigerant oil, and the like used in apparatus having the sliding parts.

2 Claims, No Drawings

LUBRICATING OIL COMPOSITION FOR SLIDING SECTION COMPRISING ALUMINUM MATERIAL, AND LUBRICATING METHOD

This application is a 371 of PCT/JP2011/066946, filed Jul. 26, 2011.

FIELD OF ART

The present invention relates to a lubricant composition that is capable of reducing friction between sliding parts in a lubrication section, at least one of which sliding parts contains an aluminum-based material, and to a method for lubricating such a lubrication section with the composition.

BACKGROUND ART

Sliding parts in engines and the like are conventionally made mainly of iron-based materials for reliability. On the other hand, aluminum-based materials are increasingly used for the purpose of weight saving of parts, which contributes to reduction of $CO_2$ emission.

Lubricants are conventionally used in internal-combustion engines and automatic transmissions for smoothing their functions. In view of the fact that heavy energy loss is suffered in friction parts, where lubricants are involved, lubricants containing a combination of various additives, including friction modifiers (FM), are used for the purpose of reducing friction losses and fuel consumption. Such reduction of friction by means of various additives has hitherto been discussed focusing on the effects on iron-based materials.

The additive compositions most effective in reducing friction losses by lubrication contain both a sulfur compound and a molybdenum-based compound (see Patent Publication 1).

However, such additive compositions have been revealed to lack sufficient effect on aluminum-based materials, which are requiring different additives and compounding techniques. It has recently been found that compounds having a hydroxyl or carboxylic group can efficiently lubricate aluminum-based materials (see Non-patent Publication 1).

PRIOR ART PUBLICATIONS

Patent Publications

Patent Publication 1: JP-2004-149762-A

Non-Patent Publications

Non-patent Publication 1: Wear 224, 180-184 (2000)

SUMMARY OF THE INVENTION

Problems to be Solved by the Invention

It is an object of the present invention to provide a lubricant composition for sliding parts containing an aluminum-based material, which composition is capable of reducing friction between sliding parts at least one of which contains an aluminum-based material, in a lubrication section.

It is another object of the present invention to provide a method for lubricating an aluminum-based member, which method is capable of achieving lubrication and reduction of friction in a lubrication section having sliding parts at least one of which contains an aluminum-based material.

Means for Solving the Problems

The present inventors have made intensive researches to find out that a phosphorus-containing carboxylic compound and a metal salt thereof (component (A)) is particularly effective for reduction of friction between sliding parts at least one of which contains an aluminum-based material, to thereby complete the present invention. The inventors have also found out that addition of an organic molybdenum compound (component (B)) and/or a phosphoric compound (component (C)) further reduces friction.

According to the present invention, there is provided a lubricant composition for sliding parts containing an aluminum-based material, wherein said lubricant composition is for use in a lubrication section having sliding parts at least one of which contains an aluminum-based material, said lubricant composition comprising a lubricant base oil, and at least one of a phosphorus-containing carboxylic compound and a metal salt thereof (component (A)) at 0.001 to 1 mass % of the composition in terms of phosphorus (sometimes referred to as the present lubricant composition hereinbelow).

According to the present invention, there is also provided a method for lubricating an aluminum-based member comprising lubricating a lubrication section having sliding parts at least one of which contains an aluminum-based material, with the present lubricant composition.

Effect of the Invention

The present lubricant composition is for use in apparatus having sliding parts part of which is made of an aluminum-based material, and is capable of effectively reducing friction between sliding parts in a lubrication section containing an aluminum-based material, particularly as drive train lubricant, grease, wet break oil, hydraulic actuation oil, turbine oil, compressor oil, bearing oil, refrigerant oil, and the like used in internal-combustion engines, automatic transmissions, manual transmissions, continuously variable transmissions, gears and the like. The lubricating method of the present invention is capable of lubricating an aluminum-based member in the above-mentioned apparatus with the present lubricant composition at low friction.

PREFERRED EMBODIMENTS OF THE INVENTION

Preferred embodiments of the present invention will now be explained in detail.

The present lubricant composition is for use in a lubrication section having sliding parts at least one of which contains an aluminum-based material. The aluminum-based material is not particularly limited as long as it may cause aluminum to be present on the surface of the sliding parts, and may include not only aluminum, but also aluminum alloys, or aluminum-containing metal materials such as various metal substrates coated with aluminum or an aluminum alloy.

The aluminum-containing metal materials which are coated with a metal material not containing aluminum but would be worn on the coated surface during use to expose the aluminum-containing metal material, are also included in the objects to be lubricated with the present lubricant composition.

Some examples of such aluminum-based materials are specifically disclosed in, for example, JP-2010-174374-A and JP-2010-5687-A.

The present lubricant composition functions more effectively on a metal surface of higher aluminum content.

The lubricant base oil used in the present lubricant composition is not particularly limited and may be mineral base oil or synthetic base oil commonly used in lubricants.

The mineral base oil may be, for example, those produced by atmospheric-distilling crude oil, vacuum-distilling the resulting atmospheric residue, and refining the resulting lubricant fraction by one or a combination of solvent deasphalting, solvent extraction, hydrocracking, solvent dewaxing, and hydrorefining; or those produced by isomerizing mineral wax or GTL wax (gas-to-liquid wax).

The sulfur content of the mineral base oil is not particularly limited, and may be usually 0 to 1.5 mass %, preferably not higher than 0.2 mass %, more preferably not higher than 0.05 mass %, still more preferably not higher than 0.005 mass %. With a lubricant base oil of a lower sulfur content, a lower-sulfur lubricant composition may be obtained which has excellent long drain interval and is capable of avoiding as much adverse effects as possible on an exhaust gas aftertreatment device particularly when used as a lubricant for internal-combustion engines.

The content of the saturated components in the mineral base oil is not particularly limited, and may be usually 50 to 100 mass %, and for excellent oxidation stability and long drain interval, preferably not lower than 60 mass %, more preferably not lower than 90 mass %, still more preferably not lower than 95 mass %.

As used herein, the content of the saturated components is determined in accordance with ASTM D2549.

The synthetic base oil may be, for example, polybutene or hydrides thereof; poly-α-olefin, such as 1-octene oligomer, 1-decene oligomer, or 1-dodecene oligomer, or hydrides thereof; diesters such as ditridecyl glutarate, di-2-ethylhexyl adipate, diisodecyl adipate, ditridecyl adipate, or di-2-ethylhexyl sebacate; polyol esters, such as neopentyl glycol esters, trimethylolpropane caprylate, trimethylolpropane pelargonate, pentaerythritol-2-ethylhexanoate, or pentaerythritol pelargonate; or aromatic synthetic oils, such as alkylnaphthalene, alkylbenzene, or aromatic esters; or mixtures thereof.

The lubricant base oil may be the mineral base oils, the synthetic base oils, or an arbitrary mixture of two or more of these. For example, one or more of the mineral base oils, one or more of the synthetic base oils, or a mixture of one or more of the mineral base oils and one or more of the synthetic base oils may be used.

The lubricant base oil may be of any kinematic viscosity without limitation. The 100° C. kinematic viscosity of the lubricant base oil may be preferably not higher than 20 $mm^2/s$, more preferably not higher than 16 $mm^2/s$, and preferably not lower than 3 $mm^2/s$, more preferably not lower than 5 $mm^2/s$. At a 100° C. kinematic viscosity of higher than 20 $mm^2/s$, the low-temperature viscosity is poor, whereas at a kinematic viscosity of lower than 3 $mm^2/s$, oil film formation at lubricating sites is insufficient, causing poor lubricity, and the evaporation loss of the lubricant base oil may be heavy.

The evaporation loss of the lubricant base oil is preferably not more than 20 mass %, more preferably not more than 16 mass %, and still more preferably not more than 10 mass %, particularly preferably not more than 6 mass %, most preferably not more than 5 mass %, as determined as NOACK evaporation loss. At NOACK evaporation loss of more than 20 mass %, not only the evaporation loss of the lubricant may be heavy and the long drain interval may be poor, but also, when the lubricant composition is used as a lubricant for internal-combustion engines, the sulfur compounds, phosphorus compounds, and metal components in the composition may deposit in an exhaust emission control system together with the lubricant base oil, to adversely affect the exhaust gas purification performance. As used herein, the NOACK evaporation loss is determined in accordance with ASTM D5800.

The viscosity index of the lubricant base oil is not particularly limited, and for achieving excellent viscosity characteristics from low to high temperatures, preferably not lower than 80, more preferably not lower than 100, most preferably not lower than 120. There is no particular upper limit for the viscosity index, and lubricant base oil having a viscosity index of about 135 to 180, such as normal paraffin, slack wax, GTL wax, or isoparaffin mineral oil produced by isomerizing these, or lubricant base oil having a viscosity index of about 150 to 250, such as complex ester base oil or HVI-PAO base oil may be used. Lubricant base oil having a viscosity index of lower than 80 may cause impaired low-temperature viscosity characteristics.

The present lubricant composition contains a particular content of at least one of a phosphorus-containing carboxylic compound and a metal salt thereof as component (A).

The phosphorus-containing carboxylic compound as component (A) may preferably be, for example, a compound represented by formula (1):

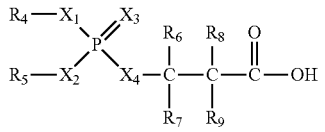

(1)

In formula (1), $X_1$ to $X_4$ each independently stands for an oxygen or sulfur atom. Preferably, two of $X_1$ to $X_4$ each stands for a sulfur atom, and the remaining two each stands for an oxygen atom. More preferably, $X_1$ and $X_2$ each stands for an oxygen atom and $X_3$ and $X_4$ each stands for a sulfur atom.

In formula (1), $R_4$ and $R_5$ each independently stands for a hydrocarbon group having 1 to 30 carbon atoms. The hydrocarbon group having 1 to 30 carbon atoms may be, for example, an alkyl, cycloalkyl, alkenyl, alkyl-substituted cycloalkyl, aryl, alkyl-substituted aryl, or arylalkyl group.

In formula (1), $R_6$ to $R_9$ each independently stands for a hydrogen atom or a hydrocarbon group having 1 to 4 carbon atoms. The hydrocarbon group may be, for example, an alkyl or alkenyl group. Preferably, at least two of $R_6$ to $R_9$ each stands for a hydrogen atom, and most preferably, all of $R_6$ to $R_9$ each stands for a hydrogen atom.

A metal salt of the phosphorus-containing carboxylic compound may be, for example, a salt obtained by neutralizing part or all of the residual acidic hydrogen of the phosphorus-containing carboxylic compound by reacting to the carboxylic compound a metal base, such as a metal oxide, metal hydroxide, metal carbonate, or metal chloride.

The metal may be an alkali metal, an alkaline earth metal, zinc, copper, aluminum, or a mixture of two or more of these.

As component (A) of the present invention, a metal salt of the phosphorus-containing carboxylic compound mentioned above is preferred for its more excellent base number retention.

Component (A) represented by formula (1) may preferably be β-dithiophosphoropropionic acid.

The content of component (A) in the present lubricant composition is 0.001 to 1 mass %, preferably 0.005 to 0.1 mass % of the composition in terms of phosphorus. At a content out of this range, the desired effects of the present invention cannot be achieved.

The present lubricant composition may optionally contain an organic molybdenum compound as component (B) and/or a phosphoric compound other than component (A) as component (C).

The organic molybdenum compound as component (B) may be, for example, molybdenum sulfide dithiocarbamate, oxymolybdenum sulfide dithiocarbamate, molybdenum sulfide dithiophosphate, oxymolybdenum sulfide dithiophosphate, a molybdenum-amine complex, a molybdenum-succinimide complex, a molybdate of an organic acid, or a molybdate of an alcohol.

The molybdenum dithiocarbamates as component (B) may be a compound represented by formula (2):

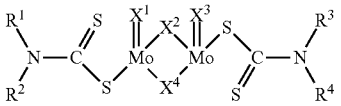

(2)

In formula (2), $R^1$, $R^2$, $R^3$, and $R^4$ may be the same or different, and each stands for a hydrocarbon group, such as an alkyl group having 2 to 24, preferably 4 to 13 carbon atoms, an aryl or alkylaryl group having 6 to 24, preferably 8 to 15 carbon atoms. As used herein, the alkyl group includes primary, secondary, and tertiary alkyl groups, and these may be straight or branched. $X^1$, $X^2$, $X^3$, and $X^4$ may be the same or different, and each stands for a sulfur or oxygen atom.

The molybdenum dithiocarbamate represented by formula (2) may preferably be, for example, molybdenum sulfide diethyldithiocarbamate, molybdenum sulfide dipropyldithiocarbamate, molybdenum sulfide dibutyldithiocarbamate, molybdenum sulfide dipentyldithiocarbamate, molybdenum sulfide dihexyldithiocarbamate, molybdenum sulfide dioctyldithiocarbamate, molybdenum sulfide didecyldithiocarbamate, molybdenum sulfide didodecyldithiocarbamate, molybdenum sulfide di(butylphenyl)dithiocarbamate, molybdenum sulfide di(nonylphenyl)dithiocarbamate, oxymolybdenum sulfide diethyldithiocarbamate, oxymolybdenum sulfide dipropyldithiocarbamate, oxymolybdenum sulfide dibutyldithiocarbamate, oxymolybdenum sulfide dipentyldithiocarbamate, oxymolybdenum sulfide dihexyldithiocarbamate, oxymolybdenum sulfide dioctyldithiocarbamate, oxymolybdenum sulfide didecyldithiocarbamate, oxymolybdenum sulfide didodecyldithiocarbamate, oxymolybdenum sulfide di(butylphenyl)dithiocarbamate, or oxymolybdenum sulfide di(nonylphenyl)dithiocarbamate. In these compounds, the alkyl groups may be straight or branched, and the alkyl group may be bound at any site in the alkylphenyl group. As such molybdenum dithiocarbamates, a compound having hydrocarbon groups of different carbon numbers in one molecule thereof, a compound having hydrocarbon groups of different structures in one molecule thereof, and a compound having hydrocarbon groups of different carbon numbers and structures in one molecule thereof, may preferably be used. The above compounds may be used alone or as a mixture of two or more of these.

The molybdenum dithiophosphates as component (B) may be a compound represented by formula (3):

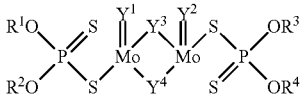

(3)

In formula (3), $R^1$, $R^2$, $R^3$, and $R^4$ may be the same or different, and each stands for a hydrocarbon group, such as an alkyl group having 2 to 30, preferably 5 to 18, more preferably 5 to 12 carbon atoms, an aryl or alkylaryl group having 6 to 18 carbon atoms. As used herein, the alkyl group includes primary, secondary, and tertiary alkyl groups, and these may be straight or branched. $Y^1$, $Y^2$, $Y^3$, and $Y^4$ may be the same or different, and each stands for a sulfur or oxygen atom.

The molybdenum dithiophosphate represented by formula (3) may be, for example, molybdenum sulfide diethyldithiophosphate, molybdenum sulfide dipropyldithiophosphate, molybdenum sulfide dibutyldithiophosphate, molybdenum sulfide dipentyldithiophosphate, molybdenum sulfide dihexyldithiophosphate, molybdenum sulfide dioctyldithiophosphate, molybdenum sulfide didecyldithiophosphate, molybdenum sulfide didodecyldithiophosphate, molybdenum sulfide di(butylphenyl)dithiophosphate, molybdenum sulfide di(nonylphenyl)dithiophosphate, oxymolybdenum sulfide diethyldithiophosphate, oxymolybdenum sulfide dipropyldithiophosphate, oxymolybdenum sulfide dibutyldithiophosphate, oxymolybdenum sulfide dipentyldithiophosphate, oxymolybdenum sulfide dihexyldithiophosphate, oxymolybdenum sulfide dioctyldithiophosphate, oxymolybdenum sulfide didecyldithiophosphate, oxymolybdenum sulfide didodecyldithiophosphate, oxymolybdenum sulfide di(butylphenyl)dithiophosphate, or oxymolybdenum sulfide di(nonylphenyl)dithiophosphate. In these compounds, the alkyl groups may be straight or branched, and the alkyl group may be bound at any site in the alkylphenyl group. As such molybdenum dithiophosphates, a compound having hydrocarbon groups of different carbon numbers in one molecule thereof, a compound having hydrocarbon groups of different structures in one molecule thereof, and a compound having hydrocarbon groups of different carbon numbers and structures in one molecule thereof, may preferably be used. The above compounds may be used alone or as a mixture of two or more of these.

The molybdenum-amine complex as component (B) may be, for example, a sulfur-free molybdenum compound, such as molybdenum trioxide or a hydrate thereof ($MoO_3.nH_2O$), molybdic acid ($H_2MoO_4$), an alkali metal salt of molybdic acid ($M_2MoO_4$ wherein M is an alkali metal salt), ammonium molybdate ($(NH_4)_2MoO_4$ or $(NH_4)_6[MO_7O_{24}].4H_2O$), $MOCl_6$, $MOOCl_4$, $MoO_2Cl_2$, $MoO_2Br_2$, or $Mo_2O_3Cl_6$. Among these, tetravalent to hexavalent, particularly hexavalent molybdenum compounds are preferred in view of the yield of the objective compound. Further, among hexavalent molybdenum compounds, in view of availability, molybdenum trioxide or hydrates thereof, molybdic acid, an alkali metal salt of molybdic acid, or ammonium molybdate is preferred.

The amine compound constituting the molybdenum-amine complex is not particularly limited, and among amines, primary amine, secondary amine, and alkanolamine are preferred.

The hydrocarbon group of the amine compound may have preferably not less than 4, more preferably 4 to 30, most preferably 8 to 18 carbon atoms. If the hydrocarbon group of an amine compound has less than 4 carbon atoms, solubility may tend to be impaired. On the other hand, with an amine compound having not more than 30 carbon atoms, the organic molybdenum compound has a relatively higher molybdenum content, and may further enhance the effects of the present invention at a small content.

The molybdenum-succinimide complex as component (B) may be, for example, a complex of the sulfur-free molybdenum compound as exemplified above in the discussion of the molybdenum-amine complex, and succinimide having an alkyl or alkenyl group with not less than 4 carbon atoms.

The succinimide may be, for example, succinimide having a C4 to 30, preferably C8 to C18 alkyl or alkenyl group.

With succinimide having an alkyl or alkenyl group with less than 4 carbon atoms, solubility may tend to be impaired. Succinimide having an alkyl or alkenyl group with more than 30 and not more than 40 carbon atoms may be used, but with an alkyl or alkenyl group having not more than 30 carbon atoms, the molybdenum-succinimide complex has a relatively higher molybdenum content, and may further enhance the effects of the present invention at a small content.

The molybdate of an organic acid may be, for example, a salt of an organic acid and a molybdenum base, such as the molybdenum oxides exemplified above in the discussion of the molybdenum-amine complex, molybdenum hydroxide, or molybdenum chloride. The organic acid may be phosphorus-containing acid or carboxylic acid, with the former being particularly preferred.

The carboxylic acid constituting the molybdate of the carboxylic acid may either be monobasic or polybasic.

The molybdate of an alcohol as component (B) may be, for example, a salt of an alcohol and a sulfur-free molybdenum compound as exemplified above in the discussion of the molybdenum-amine complex. The alcohol may be monohydric alcohol, polyhydric alcohol, partial esters or partial ethers of polyhydric alcohol, or nitrogen compounds having a hydroxyl group such as alkanolamide. Incidentally, molybdic acid, which is a strong acid, reacts with alcohol to form an ester. Such an ester of molybdic acid and alcohol is also encompassed by the molybdate of an alcohol as used herein.

In the present lubricant composition, one or a combination of two or more of the organic molybdenum compounds may be used as component (B).

The most preferred compound as component (B) is molybdenum dithiocarbamate.

In the present lubricant composition, the content of component (B), if present, is not particularly limited, and preferably not less than 50 mass ppm, more preferably not less than 400 mass ppm of the lubricant composition in terms of molybdenum element. On the other hand, in view of solubility in the lubricant base oil and storage stability, the content of component (B) is preferably not more than 2000 mass ppm, more preferably not more than 1500 mass ppm. With a content of component (B) over this upper limit, sufficient solubility in poly-α-olefin or a hydride thereof as a lubricant base oil cannot be achieved, and precipitate may form during long-term storage.

The phosphoric compound as component (C) is not particularly limited as long as it is a compound having phosphorus in its molecule, other than component (A).

The phosphoric compound as component (C) may be, for example, at least one compound selected from the group consisting of a phosphorus compound represented by formula (4), a phosphorus compound represented by formula (5), metal salts thereof, amine salts thereof, and derivatives thereof:

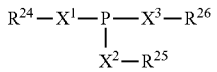

(4)

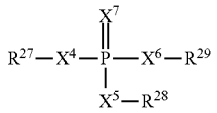

(5)

In formula (4), $X^1$, $X^2$, and $X^3$ each independently stands for an oxygen or sulfur atom. $R^{24}$, $R^{25}$, and $R^{26}$ each independently stands for a hydrogen atom or a hydrocarbon group having 1 to 30 carbon atoms. In formula (5), $X^4$, $X^5$, $X^6$, and $X^7$ each independently stands for an oxygen or sulfur atom, or one or two of $X^4$, $X^5$, and $X^6$ may be a single bond or a (poly) oxyalkylene group. $R^{27}$, $R^{28}$, and $R^{29}$ each independently stands for a hydrogen atom or a hydrocarbon group having 1 to 30 carbon atoms.

The hydrocarbon groups having 1 to 30 carbon atoms represented by $R^{24}$ to $R^{26}$ may each preferably be an alkyl group having 1 to 30 carbon atoms or an aryl group having 6 to 24 carbon atoms, more preferably an alkyl group having 3 to 18, still more preferably 4 to 12 carbon atoms.

The hydrocarbon groups having 1 to 30 carbon atoms represented by $R^{27}$ to $R^{29}$ may each preferably be an alkyl, cycloalkyl, alkenyl, alkyl-substituted cycloalkyl, aryl, alkyl-substituted aryl, or arylalkyl group.

The phosphorus compound represented by formula (4) may be, for example, phosphorous acid, monothiophosphorous acid, dithiophosphorous acid, trithiophosphorous acid; monophosphite, monothiomonophosphite, dithiomonophosphite, trithiomonophosphite, each having one of the above-mentioned C1 to C30 hydrocarbon groups; diphosphite, monothiodiphosphite, dithiodiphosphite, trithiodiphosphite, each having two of the above-mentioned C1 to C30 hydrocarbon groups; triphosphite, monothiotriphosphite, dithiotriphosphite, trithiotriphosphite, each having three of the above-mentioned C1 to C30 hydrocarbon groups; or a mixture of two or more of these.

According to the present invention, for the purpose of improving corrosive wear inhibitory property and further improving high-temperature detergency, oxidation stability, and long drain interval properties such as base number retention, preferably two or more, most preferably all of $X^1$ to $X^3$ in the formula (4) are oxygen atoms.

The phosphorus compound represented by formula (5) may be, for example, phosphoric acid, monothiophosphoric acid, dithiophosphoric acid, trithiophosphoric acid, tetrathiophosphoric acid; monophosphate, monothiomonophosphate, dithiomonophosphate, trithiomonophosphate, or tetrathiomonophosphate, each having one of the above-mentioned C1 to C30 hydrocarbon groups; diphosphate, monothiodiphosphate, dithiodiphosphate, trithiodiphosphate, or tetrathiodiphosphate, each having two of the above-mentioned C1 to C30 hydrocarbon groups; triphosphate, monothiotriphosphate, dithiotriphosphate, trithiotriphosphate, or tetrathiotriphosphate, each having three of the above-mentioned C1 to C30 hydrocarbon groups; phosphonic acid, monophosphonate, or diphosphonate, each having one to three of the above-mentioned C1 to C30 hydrocarbon group; the above-mentioned phosphorus compounds having a C1 to C4 (poly)oxyalkylene group; derivatives of the above-mentioned phosphorus compounds, such as a reaction product of β-dithiophosphorylpropionic acid or dithiophosphoric acid and olefin cyclopentadiene or (methyl)methacrylic acid; or a mixture of two or more of these.

According to the present invention, for the purpose of further improving high temperature detergency, oxidation stability, and long drain interval properties such as base number retention, preferably two or more, more preferably three or more, and most preferably all of $X^4$ to $X^7$ in formula (5) are oxygen atoms. Alternatively, one or two of $X^4$, $X^5$, and $X^6$ may be a single bond or a (poly) oxyalkylene group.

A salt of the phosphorus compound represented by formula (4) or (5) may be, for example, a salt obtained by neutralizing part or all of the residual acidic hydrogen of the phosphorus compound by reacting to the phosphorus compound a metal base, such as a metal oxide, metal hydroxide, metal carbonate, or metal chloride, or a nitrogen compound, such as ammonia or an amine compound having in its molecules only a C1 to C30 hydrocarbon group or a hydrocarbon group having a hydroxyl group.

The metal of the metal base may be, for example, an alkali metal, such as lithium, sodium, potassium, or cesium; an alkaline earth metal, such as calcium, magnesium, or barium; or a heavy metal, such as zinc, copper, iron, lead, nickel, silver, or manganese. Among these, an alkaline earth metal, such as calcium or magnesium, or zinc is preferred.

The metal salts of the phosphorus compounds may have different structures, without limitation, depending on the valency of the metal or the number of the OH— or SH— groups of the phosphorus compound. For example, when 1 mole of zinc oxide is reacted with 2 moles of diphosphate (having one OH group), it is assumed that a compound represented by formula (6) below is mainly obtained, but polymerized molecules are also present. When 1 mole of zinc oxide is reacted with 1 mole of monophosphate (having two OH groups), it is assumed that a compound represented by formula (7) below is mainly obtained, but polymerized molecules are also present.

(6)

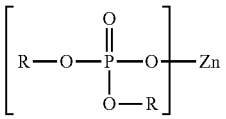

(7)

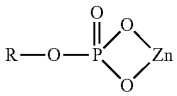

In formulae (6) and (7), R's each independently stands for an alkyl or aryl group having 3 to 18 carbon atoms. Such metal salt of the phosphorus compound may preferably be a salt of diphosphite having two C3 to C18 alkyl or aryl groups and zinc or calcium, a salt of triphosphite having three C3 to C18 alkyl or aryl groups, preferably C6 to C12 alkyl groups and zinc or calcium, a salt of monophosphate having one C3 to C18 alkyl or aryl group and zinc or calcium, a salt of diphosphate having two C3 to C18 alkyl or aryl groups and zinc or calcium, a salt of monophosphonate having two C1 to C18 alkyl or aryl groups and zinc or calcium, a salt of triphosphate having three C3 to C18 alkyl or aryl groups, preferably C6 to C12 alkyl groups and zinc or calcium, or a salt of diphosphonate having three C1 to C18 alkyl or aryl groups and zinc or calcium. These may be used alone or as a mixture of two or more of these selected arbitrarily.

The phosphoric compound as component (C) may also be, other than the above, zinc dithiophosphate. The zinc dithiophosphate may be a compound represented by formula (8).

(8)

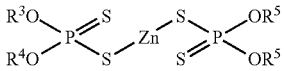

In formula (8), $R^3$, $R^4$, $R^5$, and $R^6$ each independently stands for a hydrocarbon group having 1 to 24 carbon atoms, such as a C1 to C24 straight or branched alkyl group, a C3 to C24 straight or branched alkenyl group, a C5 to C13 cycloalkyl or straight or branched alkylcycloalkyl group, a C6 to C18 aryl or straight or branched alkylaryl group, or a C7 to C19 arylaklyl group. The alkyl and alkenyl groups may be primary, secondary, or tertiary.

Among the above-mentioned hydrocarbon groups represented by $R^3$, $R^4$, $R^5$, or $R^6$, a C1 to C18 straight or branched alkyl group, or a C6 to C18 aryl or straight or branched alkylaryl group is particularly preferred.

The zinc dithiophosphate may be produced by any conventional method without particular limitation, for example, by reacting an alcohol or phenol having hydrocarbon groups corresponding to $R^3$, $R^4$, $R^5$, and $R^6$ with diphosphorus pentasulfide to synthesize dithiophosphoric acid, and neutralizing the same with zinc oxide. The structure of the zinc dithiophosphate varies depending on the raw material alcohol used.

As component (C), the zinc salts of the phosphoric compounds represented by formula (6) or (7) are most preferred.

In the present lubricant composition, the content of the phosphoric compound as component (C), if present, is not particularly limited, and usually not less than 0.005 mass %, preferably not less than 0.01 mass %, more preferably not less than 0.02 mass %, of the lubricant composition in terms of phosphorus element. On the other hand, the content of component (C), if present, is preferably not more than 0.12 mass %, more preferably not more than 0.1 mass %, particularly preferably not more than 0.08 mass % of the lubricant composition in terms of phosphorus element. A content of the phosphoric compound as component (C) of less than 0.005 mass % in terms of phosphorus element is not preferred since anti-wear effect is not achieved, whereas a content of the compound of more than 0.12 mass % in terms of phosphorus element may cause adverse effect on an exhaust gas aftertreatment device.

When the present lubricant composition contains the phosphoric compounds, components (A) and (C), the total content of these components is not more than 0.15 mass %, preferably not more than 0.1 mass %, more preferably not more than 0.08 mass % of the lubricant composition in terms of phosphorus element. A total content over 0.15 mass % may adversely affect an exhaust gas aftertreatment device.

The present lubricant composition may optionally contain any additives that are commonly used in lubricants for further improving its performance or depending on other purposes. Such additives may include, other than components (A), (B), and (C), for example, metal detergents, ashless dispersants, anti-oxidants, friction modifiers, anti-wear agents, viscosity index improvers, corrosion inhibitors, rust inhibitors, demulsifiers, metal deactivators, foam inhibitors, coloring agents, or a combination of two or more of these.

Examples of the metal detergents may include salicylate detergents, sulfonate detergents, and phenate detergents.

The salicylate detergents have monoalkyl, dialkyl, or other structures, wherein the alkyl groups in the dialkyl group may be the same or different. The alkyl groups may each be a C1 to C32 straight or branched alkyl group, and preferably include an at least C8 to C32, more preferably C14 to 32, straight or branched alkyl group.

The metals in the salicylate detergents may be alkali or alkaline earth metals, specifically, sodium, potassium, calcium, or magnesium, preferably calcium or magnesium, particularly calcium.

The sulfonate detergents may be metal salts, preferably alkaline earth metal salts, particularly magnesium and/or calcium salt, of alkyl aromatic sulfonic acid obtained by sulfonating an alkyl aromatic compound having a molecular weight of 100 to 1500, preferably 200 to 700.

The phenate detergents may be, for example, alkylphenol having at least one C4 to C30, preferably C6 to C18 straight or branched alkyl group, alkylphenol sulfide obtained by reacting this alkylphenol with elemental sulfur, or metal salts, preferably alkaline earth metal salt, particularly magnesium and/or calcium salt, of a Mannich reaction product of this alkylphenol obtained by reacting the alkylphenol with formaldehyde.

The metal detergents may include not only neutral salts (normal salts), but also basic salts obtained by heating neutral salts (normal salts) with excess alkaline earth metal salts or alkaline earth metal base (hydroxides or oxides of alkaline earth metal) in the presence of water, and overbased salts (ultrabasic salts) obtained by reacting neutral salts (normal salts) with a base such as a hydroxide of alkali metal or alkaline earth metal in the presence of carbon dioxide gas, boric acid, or borate.

The ashless dispersants may be any ashless dispersants that are used in lubricants, for example, nitrogen-containing compounds having in its molecule at least one C40 to C400 straight or branched alkyl or alkenyl group, or derivatives thereof. The nitrogen-containing compounds may be, for example, succinimide, benzylamine, polyamine, or Mannich base, and the derivatives of the compounds may be those obtained by reacting, to the nitrogen-containing compounds, boron compounds such as boric acid or borates, phosphorus compounds such as (thio)phosphoric acid or (thio)phosphates, organic acids, or hydroxyl (poly)oxyalkylene carbonate. In the composition of the present invention, one, two, or more arbitrarily selected from these may be contained.

In the ashless dispersants, the alkyl or alkenyl group has 40 to 400, preferably 60 to 350 carbon atoms. With an alkyl or alkenyl group having less than 40 carbon atoms, solubility of the compound in the lubricant base oil is low, whereas with an alkyl or alkenyl group having more than 400 carbon atoms, low-temperature fluidity of the lubricant composition is poor, both being not preferred.

The alkyl or alkenyl group may either be straight or branched, and specifically a branched alkyl or alkenyl group derived from oligomers of olefin such as propylene, 1-butene, or isobutylene, or cooligomer of ethylene and propylene is preferred. According to the present invention, among these ashless dispersants, succinimide having a branched alkyl or alkenyl group, particularly poly(iso)butenyl group, having number average molecular weight of 700 to 4000, preferably 1000 to 2000, more preferably 1200 to 1500, and/or a boron compound derivative thereof, is preferred. Anti-wear property and oxidation stability may be improved even when non-modified succinimide is used, and it is most preferred to use both the succinimide and a boron compound derivative thereof.

According to the present invention, the content of the ashless dispersants, if present, is not particularly limited, and usually 0.1 to 20 mass %, preferably 3 to 15 mass % of the composition. When the boron compound derivative of succinimide is used as the ashless dispersant, the boron content thereof is not particularly limited, and preferably not less than 0.005 mass %, more preferably not less than 0.01 mass %, most preferably not less than 0.02 mass % of the compound in terms of boron. As the content of the boron compound derivative is increased, sealing materials may be affected and the sulfated ash content may be increased, so that the content of the boron compound derivative may be preferably not more than 0.2 mass %, more preferably not more than 0.1 mass %, still more preferably not more than 0.08 mass %, still more preferably not more than 0.06 mass %, most preferably not more than 0.04 mass %, in terms of boron.

The anti-oxidants may be those commonly used in lubricants, including ashless anti-oxidants such as phenol anti-oxidants or amine anti-oxidants, or organic metal anti-oxidants. With the addition of the anti-oxidants, the lubricant composition is given further improved anti-oxidation property, and not only corrosive wear inhibitory property, but also base number retention of the present composition is further improved.

Thephenolanti-oxidantsmaypreferablybe, for example,
4,4'-methylenebis(2,6-di-tert-butylphenol),
4,4'-bis(2,6-di-tert-butylphenol),
4,4'-bis(2-methyl-6-tert-butylphenol),
2,2'-methylenebis(4-ethyl-6-tert-butylphenol),
2,2'-methylenebis(4-methyl-6-tert-butylphenol),
4,4'-butylidenebis(3-methyl-6-tert-butylphenol),
4,4'-isopropylidenebis(2,6-di-tert-butylphenol),
2,2'-methylenebis(4-methyl-6-nonylphenol),
2,2'-isobutylidenebis(4,6-dimethylphenol),
2,2'-methylenebis(4-methyl-6-cyclohexylphenol),
2,6-di-tert-butyl-4-methylphenol,
2,6-di-tert-butyl-4-ethylphenol,
2,4-dimethyl-6-tert-butylphenol,
2,6-di-tert-butyl-α-dimethylamino-p-cresol,
2,6-di-tert-butyl-4(N,N'-dimethylaminomethylphenol),
4,4'-thiobis(2-methyl-6-tert-butylphenol),
4,4'-thiobis(3-methyl-6-tert-butylphenol),
2,2'-thiobis(4-methyl-6-tert-butylphenol),
bis(3-methyl-4-hydroxy-5-tert-butylbenzyl)sulfide,
bis(3,5-di-tert-butyl-4-hydroxybenzyl)sulfide,
2,2'-thio-diethylenebis[3-(3,5-di-tert-butyl-4-hydroxy phenyl)propionate],
tridecyl-3-(3,5-di-tert-butyl-4-hydroxyphenyl) propionate,
pentaerythrityl-tetrakis[3-(3,5-di-tert-butyl-4-hydroxyphenyl)propionate],
octyl-3-(3,5-di-tert-butyl-4-hydroxyphenyl)propionate,
octadecyl-3-(3,5-di-tert-butyl-4-hydroxyphenyl) propionate, or
3-methyl-5-tert-butyl-4-hydroxyphenyl-substituted fatty acid esters. These may be used as a mixture of two or more of these.

The amine anti-oxidants may be, for example, phenyl-α-naphthylamine, alkylphenyl-α-naphthylamine, or dialkyldiphenylamine. These may be used as a mixture of two or more of these.

The phenol anti-oxidants, amine anti-oxidants, and organic metal anti-oxidants may be used in combination.

The content of the anti-oxidants in the present lubricant composition is usually not more than 10 mass %, preferably not more than 5 mass %, still more preferably not more than 3 mass % of the composition. At more than 10 mass %, sufficient performance corresponding to the content is not achieved, which is not preferred. On the other hand, for maintaining the corrosive wear inhibitory property for a longer period of time, the content of the anti-oxidants is preferably not less than 0.05 mass %, more preferably not less than 0.1 mass %, most preferably not less than 0.5 mass % of the composition.

The friction modifiers may be any compounds that are commonly used as a friction modifier in lubricants, for example, other than the organic molybdenum compound as component (B), ashless friction modifiers including amine compounds such as oleylamine, fatty acid esters such as oleylglyceride, fatty acid amides such as oleic amide, succinimide, which is a condensation product of isostearylsuccinic acid and polyamine, fatty acids such as oleic acid, alkylamine hydroxyl compound obtained, for example, by addition of a plurality of moles of ethylene oxide to stearylamine, aliphatic alcohols, aliphatic ethers, hydrazides (such as oleyl hydrazide), semicarbazides, urea, ureido, or biuret, each having in its molecule at least one C6 to C30 alkyl or alkenyl group, in particular C6 to C30 straight alkyl or straight alkenyl group. The content of the friction modifiers may be usually 0.01 to 5 mass % of the composition.

The anti-wear agents may be any anti-wear agents as required that are commonly used in lubricants, such as, other than the phosphoric compound or zinc dithiophosphate as component (C), sulfur-containing anti-wear agents or boron-containing anti-wear agents.

Examples of the sulfur-containing anti-wear agents may include sulfur-containing compounds, such as disulfides, sulfurized olefins, sulfurized oils and fats, dithiocarbamate, or zinc dithiocarbamate. Such sulfur-containing compounds may be contained in the composition so that the total sulfur content of the composition is within a preferred range of 0.005 to 5 mass %. For inhibition of corrosive wear, the content of the sulfur-containing compounds is not more than 0.15 mass %, preferably not more than 0.1 mass %, particularly not more than 0.05 mass %, or none, so that a lubricant composition of a low sulfur content and long drain interval may be provided.

Combination of the sulfur compounds with the molybdenum compounds is effective in reduction of friction and its sustention, and thiadiazole is particularly effective.

The viscosity index improvers may be, for example, so called non-dispersant type viscosity index improvers, such as polymers or copolymers of one, two, or more monomers selected from various methacrylates, or hydrogenation products thereof, so called dispersant type viscosity index improvers, such as copolymers of various methacrylates including nitrogen compounds, non-dispersant or dispersant type ethylene-α-olefin copolymers (α-olefin may be propylene, 1-butene, 1-pentene, or the like) or hydrides thereof, polyisobutylene or hydrogenated products thereof, hydrides of styrene-diene copolymers, styrene-maleic anhydride ester copolymers, or polyalkylstyrene.

The molecular weight of the viscosity index improvers has to be selected taking shear stability into account. Specifically, the number average molecular weight of the viscosity index improvers, for example, in the case of dispersant or non-dispersant type polymethacrylates, may be usually 5000 to 1000000, preferably 100000 to 900000, in the case of polyisobutylene or hydrides thereof, usually 800 to 5000, preferably 1000 to 4000, and in the case of ethylene-α-olefin copolymers or hydrides thereof, usually 800 to 500000, preferably 3000 to 200000.

Among these viscosity index improvers, ethylene-α-olefin copolymers or hydrides thereof give a lubricant composition of particularly excellent shear stability. One, two, or more compounds arbitrarily selected from the above-mentioned viscosity index improvers may be used in any amount. The content of the viscosity index improvers may usually be 0.1 to 20 mass % of the lubricant composition.

The corrosion inhibitors may be, for example, benzotriazole, tolyltriazole, thiadiazole, or imidazole compounds.

The rust inhibitors may be, for example, petroleum sulfonates, alkylbenzene sulfonates, dinonylnaphthalene sulfonates, alkenylsuccinates, or esters of polyhydric alcohols.

The demulsifiers may be, for example, polyalkylene glycol nonionic surfactants, such as polyoxyethylene alkyl ethers, polyoxyethylene alkylphenyl ethers, or polyoxyethylene alkylnaphthyl ethers.

The metal deactivators may be, for example, imidazoline, pyrimidine derivatives, alkylthiadiazole, mercaptobenzothiazole, benzotriazole or derivatives thereof, 1,3,4-thiadiazole polysulfide, 1,3,4-thiadiazolyl-2,5-bisdialkyldithiocarbamate, 2-(alkyldithio)benzoimidazole, or β-(o-carboxybenzylthio)propionitrile.

Thiadiazole also falls under the category of the sulfur compounds, and combination with the molybdenum compounds is particularly effective in reduction of friction and its sustention.

The foam inhibitors may be, for example, silicon, fluorosilicon, or fluoroalkyl ether.

When these additives are contained in the present lubricant composition, the content of each of the corrosion inhibitors, rust inhibitors, and demulsifiers may usually be 0.005 to 5 mass %, the content of the metal deactivators may usually be 0.005 to 1 mass %, and the content of the foam inhibitors may usually be 0.0005 to 1 mass %, of the lubricant composition.

The lubricant composition suitable for use in contact with an aluminum-based material according to the present invention may preferably be used as lubricant, such as drive-train lubricant for automatic or manual transmissions, grease, wet brake oil, hydraulic actuation oil, turbine oil, compressor oil, bearing oil, or refrigerant oil.

According to the lubricating method of the present invention, a lubrication section of the above-mentioned machinery having sliding parts at least one of which contains an aluminum-based material may be lubricated using the present lubricant composition.

EXAMPLES

The present invention will now be explained in more detail with reference to Examples and Comparative Examples, which do not limit the present invention.

Examples 1 to 6 and Comparative Examples 1 to 8

A lubricant composition was prepared by admixing the additives of the composition shown in Tables 1 and 2 to the lubricant base oil shown in Tables 1 and 2 according to a routine procedure. The obtained lubricant composition was measured for a friction coefficient and wear depth of an aluminum material as shown below. The results are shown in Tables 1 and 2.

The equipment and methods employed in the tests are as follows:

Name of the test equipment: Kimura-Wakabayashi-type tribo-modular (manufactured by SHINKO ENGINEERING CO., LTD.)

This test equipment is of a type in which one pin is pressed against a rotating disk.

This pin is made of a JIS S45C thermally refined material, and is 4 mm in diameter and 6 mm in length. The disk is made of an Al alloy for engine sliding bearings, and is 10 mm in diameter and 1.2 mm in thickness.

The test conditions are: slip rate: 0.3 m/s, 1.05 m/s; load: 29.4N (60 min.); test temperature: room temperature.

According to this test, when the wear depth of the aluminum material is less than 10 μm, anti-wear property may be determined to be of no problem and, when wear depth of the aluminum material is of no problem, lubricating performance may be evaluated by friction coefficient.

TABLE 1

| | | Ex. 1 | Ex. 2 | Ex. 3 | Ex. 4 | Ex. 5 | Ex. 6 |
|---|---|---|---|---|---|---|---|
| Lubricant base oil *1) | mass % | Balance | Balance | Balance | Balance | Balance | Balance |
| (A) Phosphorus-containing carboxylic compound *2) | mass % | 0.21 | 0.21 | 0.21 | 0.21 | 0.21 | 0.21 |
| Amount in terms of phosphorus element | mass % | (0.02) | (0.02) | (0.02) | (0.02) | (0.02) | (0.02) |
| (B) Sulfur-containing Mo complex *3) | mass % | — | 0.77 | 0.77 | 0.77 | 0.77 | 0.77 |
| Amount in terms of molybdenum element | mass % | — | (0.07) | (0.07) | (0.07) | (0.07) | (0.07) |
| (C) Zinc dialkyl phosphate *4) | mass % | — | — | 0.68 | — | — | — |
| Amount in terms of phosphorus element | mass % | — | — | (0.06) | — | — | — |
| (C) Zinc dialkyl monothiophosphate*5) | mass % | — | — | — | 0.71 | — | — |
| Amount in terms of phosphorus element | mass % | — | — | — | (0.06) | — | — |
| (C) Zinc dialkyl dithiophosphate-1*6) | mass % | — | — | — | — | 0.75 | — |
| Amount in terms of phosphorus element | mass % | — | — | — | — | (0.08) | — |
| (C) Zinc dialkyl dithiophosphate-2*7) | mass % | — | — | — | — | — | 0.75 |
| Amount in terms of phosphorus element | mass % | — | — | — | — | — | (0.06) |
| Friction coefficient | | 0.036 | 0.035 | 0.027 | 0.031 | 0.029 | 0.032 |
| Wear depth of aluminum material | μm | 7 | 7 | 4 | 6 | 6 | 5 |

*1) Poly-α-olefin; total aromatic content: 0 mass %; sulfur content: 0 mass ppm; 100° C. kinematic viscosity: 1.7 $mm^2/s$; viscosity index: 125

*2) β-dithiophosphoropropionic acid; phosphorus content: 9.1 mass %; sulfur content: 19.7 mass %

*3) Molybdenum dithiocarbamate; Mo content: 9.0 mass %, sulfur content: 10 mass %

*4) Alkyl group: n-octyl group; phosphorus content: 8.8 mass %, sulfur content: 0.0 mass %; zinc content: 9.1 mass %

*5) Alkyl group: n-octyl group; phosphorus content: 8.4 mass %; sulfur content: 8.6 mass %; zinc content: 8.7 mass %

*6) Alkyl group: n-octyl group; phosphorus content: 8.0 mass %; sulfur content: 16.6 mass %, zinc content: 8.3 mass %

*7) Alkyl group: sec-hexyl group; phosphorus content: 8.06 mass %; sulfur content: 17.3 mass %; zinc content: 8.6 mass %

TABLE 2

| | | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 |
|---|---|---|---|---|---|---|---|---|---|
| Lubricant base oil *1) | mass % | Balance | Balance | Balance | Balance | Balance | Balance | Balance | Balance |
| (A) Phosphorus-containing carboxylic compound *2) | mass % | — | — | — | — | — | — | — | — |
| Amount in terms of phosphorus element | mass % | — | — | — | — | — | — | — | — |
| (B) Sulfur-containing Mo complex *3) | mass % | — | — | — | — | 0.77 | 0.77 | 0.77 | 0.77 |
| Amount in terms of molybdenum element | mass % | — | — | — | — | (0.07) | (0.07) | (0.07) | (0.07) |
| (C) Zinc dialkyl phosphate *4) | mass % | 0.9 | — | — | — | 0.9 | — | — | — |
| Amount in terms of phosphorus element | mass % | (0.08) | — | — | — | (0.08) | — | — | — |
| (C) Zinc dialkyl monothiophosphate*5) | mass % | — | 0.95 | — | — | — | 0.95 | — | — |
| Amount in terms of phosphorus element | mass % | — | (0.08) | — | — | — | (0.08) | — | — |
| (C) Zinc dialkyl dithiophosphate-1*6) | mass % | — | — | 1 | — | — | — | 1 | — |
| Amount in terms of phosphorus element | mass % | — | — | (0.08) | — | — | — | (0.08) | — |
| (C) Zinc dialkyl dithiophosphate-2*7) | mass % | — | — | — | 1 | — | — | — | 1 |
| Amount in terms of phosphorus element | mass % | — | — | — | (0.08) | — | — | — | (0.08) |
| Friction coefficient | | 0.045 | 0.057 | 0.053 | 0.106 | 0.05 | 0.068 | 0.089 | 0.081 |
| Wear depth of aluminum material | μm | 4 | 5 | 4 | 8 | 7 | 11 | 12 | 9 |

*1) Poly-α-olefin; total aromatic content: 0 mass %; sulfur content: 0 mass ppm; 100° C. kinematic viscosity: 1.7 $mm^2/s$; viscosity index: 125

*2) β-dithiophosphoropropionic acid; phosphorus content: 9.1 mass %; sulfur content: 19.7 mass %

*3) Molybdenum dithiocarbamate; Mo content: 9.0 mass %, sulfur content: 10 mass %

*4) Alkyl group: n-octyl group; phosphorus content: 8.8 mass %, sulfur content: 0.0 mass %; zinc content: 9.1 mass %

*5) Alkyl group: n-octyl group; phosphorus content: 8.4 mass %; sulfur content: 8.6 mass %; zinc content: 8.7 mass %

*6) Alkyl group: n-octyl group; phosphorus content: 8.0 mass %; sulfur content: 16.6 mass %, zinc content: 8.3 mass %

*7) Alkyl group: sec-hexyl group; phosphorus content: 8.06 mass %; sulfur content: 17.3 mass %; zinc content: 8.6 mass %

What is claimed is:

1. A method for lubricating an aluminum-based member comprising lubricating a lubrication section having sliding parts at least one of which contains an aluminum-based material and has aluminum present on a surface thereof, with a lubricant composition, said lubricant composition comprising:

a lubricant base oil, at least one of a phosphorus-containing carboxylic compound of formula (1) and a metal salt thereof (component (A)) at 0.005 to 0.1 mass % of the composition in terms of phosphorus:

(1)

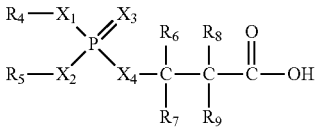

wherein $X_1$ to $X_4$ each independently stands for an oxygen or sulfur atom, $R_4$ and $R_5$ each independently stands for a hydrocarbon group having 1 to 30 carbon atoms, and $R_6$ to $R_9$ each independently stands for a hydrogen atom or a hydrocarbon group having 1 to 4 carbon atoms, molybdenum dithiocarbamate (component (B)) at 400 to 1500 mass ppm of the composition in terms of molybdenum, and a zinc dialkyl phosphate compound (component (C)) at 0.02 to 0.08 mass % of the composition in terms of phosphorus, wherein two alkyls of said zinc dialkyl phosphate compound each independently has 3 to 18 carbon atoms, wherein the total content of components (A) and (C) is not more than 0.15 mass % in terms of phosphorus element.

2. The method for lubricating an aluminum-based member according to claim 1, wherein said component (A) is β-dithiophosphoropropionic acid at 0.02 to 0.1 mass % of the composition in terms of phosphorus.

* * * * *